US010890351B2

(12) United States Patent
Reider et al.

(10) Patent No.: US 10,890,351 B2
(45) Date of Patent: Jan. 12, 2021

(54) HYDRONIC SYSTEM AND METHOD FOR OPERATING SUCH HYDRONIC SYSTEM

(71) Applicant: BELIMO HOLDING AG, Hinwil (CH)

(72) Inventors: Forest Reider, Wetzikon (CH); Marc Thuillard, Uetikon am See (CH); Stefan Mischler, Wald (CH); Ronald Aeberhard, Grut (CH)

(73) Assignee: BELIMO HOLDING AG, Hinwil (CH)

( * ) Notice: Subject to any disclaimer, the term of this patent is extended or adjusted under 35 U.S.C. 154(b) by 0 days.

(21) Appl. No.: 16/333,354

(22) PCT Filed: Sep. 19, 2017

(86) PCT No.: PCT/EP2017/073640
§ 371 (c)(1),
(2) Date: Mar. 14, 2019

(87) PCT Pub. No.: WO2018/095609
PCT Pub. Date: May 31, 2018

(65) Prior Publication Data

US 2019/0264947 A1 Aug. 29, 2019

(30) Foreign Application Priority Data

Nov. 22, 2016 (CH) ..... 1540/16

(51) Int. Cl.
*F24F 11/84* (2018.01)
*F24D 19/10* (2006.01)

(52) U.S. Cl.
CPC ..... *F24F 11/84* (2018.01); *F24D 19/1009* (2013.01); *F24D 19/1036* (2013.01); *F24D 2220/044* (2013.01)

(58) Field of Classification Search
CPC ... F24F 11/84; F24D 19/1036; F24D 19/1009
See application file for complete search history.

(56) References Cited

U.S. PATENT DOCUMENTS 3,170,630 A 2/1965 Chadwick
4,698,745 A * 10/1987 Hiroi ..... G05B 13/04 700/37

(Continued)

FOREIGN PATENT DOCUMENTS

CN 1725150 A 1/2006
CN 101709899 A 5/2010

(Continued)

OTHER PUBLICATIONS

Written Opinion of the International Searching Authority PCT/EP2017/073640 dated May 15, 2018.

(Continued)

*Primary Examiner* — Vincent H Tran
(74) *Attorney, Agent, or Firm* — Sughrue Mion, PLLC

(57) ABSTRACT

A hydronic system (HS) that comprises at least one hydronic circuit (HC) and a control (CT) for controlling the operation of said at least one hydronic circuit (HC) via a control path (CP), whereby said control (CT) comprises a feed forward controller (FFC). Operation of the system is improved by the hydronic system (HS) further comprising a control improvement path (CIP) running from the at least one hydronic circuit (HC) to the control (CT). Due to the control improvement path (CIP), the control (CT) can be improved in the case of the hydronic system (HS) becoming instable and/or showing poor system control.

20 Claims, 7 Drawing Sheets

(56) References Cited

U.S. PATENT DOCUMENTS

| | | | | |
|---|---|---|---|---|
| 6,095,426 | A * | 8/2000 | Ahmed | G05B 11/42 236/49.3 |
| 2009/0005912 | A1* | 1/2009 | Srivastava | G05B 13/044 700/276 |
| 2009/0294472 | A1* | 12/2009 | Buckley | B05C 5/0225 222/59 |
| 2011/0146799 | A1* | 6/2011 | Kiesbauer | F04D 15/0022 137/1 |
| 2014/0150883 | A1 | 6/2014 | Lederle et al. | |
| 2015/0316935 | A1 | 11/2015 | Schmidlin et al. | |
| 2019/0107292 | A1* | 4/2019 | Mischler | F24D 19/1015 |
| 2019/0212022 | A1* | 7/2019 | Aeberhard | F24F 11/65 |

FOREIGN PATENT DOCUMENTS

| | | | |
|---|---|---|---|
| CN | 103842732 | A | 6/2014 |
| CN | 104995458 | A | 10/2015 |
| CN | 204717081 | U | 10/2015 |
| EP | 0 035 085 | A1 | 9/1981 |
| EP | 1 160 552 | A1 | 12/2001 |
| EP | 1 770 469 | A2 | 4/2007 |
| EP | 2 728 269 | A1 | 5/2014 |
| WO | 00/55545 | A2 | 9/2000 |
| WO | 2013/000785 | A2 | 1/2013 |
| WO | 2014/094991 | A1 | 6/2014 |
| WO | 2016/156556 | A1 | 10/2016 |

OTHER PUBLICATIONS

International Search Report PCT/EP2017/073640 dated May 15, 2018.

Search Report CH 15402016 dated Feb. 27, 2017.

Communication dated Jul. 3, 2020 from the National Intellectual Property Administration, P.R. China in Application No. 201780070812.5.

* cited by examiner

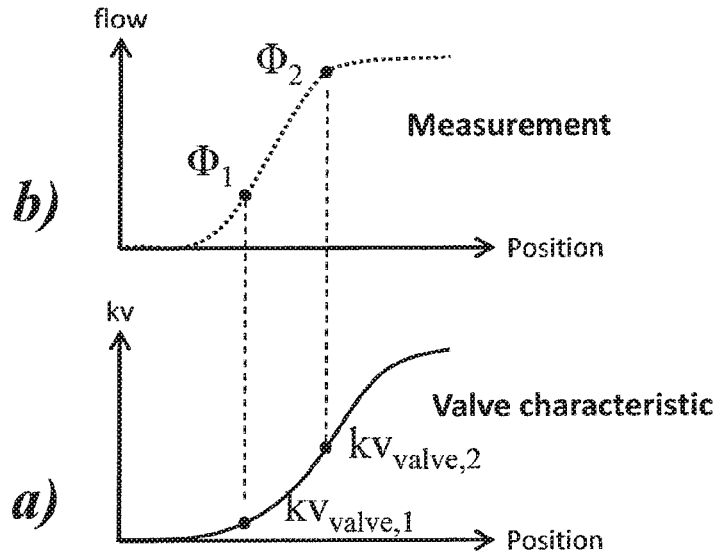
*Fig.4*
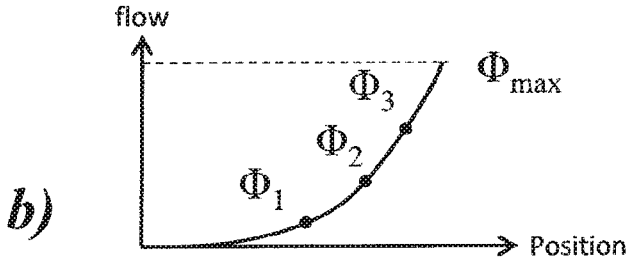
*Fig.5*
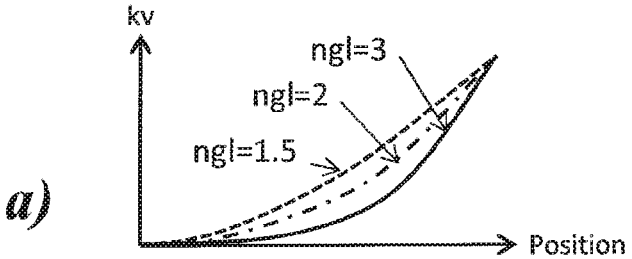

HYDRONIC SYSTEM AND METHOD FOR OPERATING SUCH HYDRONIC SYSTEM

CROSS REFERENCE TO RELATED APPLICATIONS

This application is a National Stage of International Application No. PCT/EP2017/073640 filed Sep. 19, 2017, claiming priority based on Swiss Patent Application No. 01540/16 filed Nov. 22, 2016.

BACKGROUND OF THE INVENTION

The present invention relates to hydronic systems. It refers to a hydronic system according to the preamble of claim 1.

It further refers to a method for operating such a hydronic system.

PRIOR ART

Hydronic systems are part of the HVAC sector. In most cases, such hydronic systems comprise one or more control valves, which are used to control the flow of a fluid (liquid or gaseous) through a piping, which connects various parts of the hydronic system.

Related to these control valves is the well-known concept of so-called "valve authority".

As shown in FIG. 2 a hydronic system 20 in a general form comprises in a closed circuit a pump 11, a two-port control valve 12 and a terminal unit, in this case a heat exchanger 13. Pump 11, control valve 12 and terminal unit 13 are connected in series. When pump 11 pumps the fluid through the circuit with a certain pressure, there are pressure drops Δp in the various sections of the system. These pressure drops or differential pressures can be divided into a first differential pressure $\Delta p_{valve}$ at the control valve 12 and a second differential pressure $\Delta p_{circuit}$ at the rest of the circuit (see FIG. 2).

Now, when such a hydronic system 20 is commissioned, control valve 12 has to be chosen in accordance with the needs of the system:

When control valve 12 is undersized, the pressure drop of the entire system is increased which means that pump 11 would use a larger amount of energy to pump sufficient fluid through the system. On the other hand the accuracy of the control is increased as the entire control range of the valve may be utilized to achieve the desired control.

When the control valve is oversized, the amount of energy needed to pump the necessary flow through the system would be reduced. However, such energy savings will come at the cost of a decrease in control accuracy at the control valve 12, as the initial travel of the valve from fully open towards a more closed position would have no effect on the fluid flow. Thus, only a relatively small fraction of the entire control range of valve 12 is useful for control leading to an insufficient control with poor stability and accuracy.

Thus, a trade off exists between the above two scenarios; and a proper sizing of control valve 12 requires a compromise between control accuracy and reduction of energy loss. This is, where the valve authority concept comes into play.

The valve authority N of a control valve like control valve 12 is defined as:

$$N = \frac{\Delta p_{valve}}{\Delta p_{valve} + \Delta p_{circuit}} = \frac{kv_{circuit}^2}{kv_{circuit}^2 + kvs_{valve}^2}, \quad 1)$$

where $\Delta p_{valve}$ the pressure drop across the fully open control valve, $\Delta p_{circuit}$ is the pressure drop across the remainder of the circuit, $kvs_{valve}$ is the flow coefficient (in metric units) of the fully open control valve, and $kv_{circuit}$ is the respective flow coefficient of the remainder of the circuit outside the control valve.

In other words, the valve authority N within a hydronic system indicates how much of the system's total pressure drop comes from the control valve. In practice a range of the valve authority N between 0.2 and 0.5 is considered acceptable. In accordance with equation (1) above, if valve authority N is too high (above 0.5 or 50%), then the control valve is likely to be undersized and so the hydronic system would benefit from a larger size valve in order to reduce losses that are driven by excessive pressure drop. If the value is too low (below 0.2 or 20%), then the valve movements will have only a marginal impact relative to the total system and hence the valve is likely to be oversized, yielding poor control.

In general, the flow coefficient kv of a part x of a hydronic system (as used in equation (1)) is defined by the relation $$kv_x = \frac{\Phi}{\sqrt{\Delta p_x}} \quad 2)$$

for water as the fluid, having a specific gravity G=1, wherein Φ is the fluid flow through the part, and $\Delta p_x$ is the pressure drop across part x.

Accordingly, $$kv_{circuit} = \frac{\Phi}{\sqrt{\Delta p_{circuit}}} \quad 3)$$

and $$kv_{valve} = \frac{\Phi}{\sqrt{\Delta p_{valve}}}. \quad 4)$$

Valve authority N has been used in the past in control schemes in an HVAC environment.

Document U.S. Pat. No. 5,579,993 A is directed to a controller implemented in a heating, ventilation and air-conditioning (HVAC) distribution system, which provides improved control by implementing a general regression neural network (GRNN) to generate a control signal based on identified characteristics of components utilized within the HVAC system.

The local controller disclosed in U.S. Pat. No. 5,579,993 A includes a feedforward means for generating a feedforward control signal based on the identified characteristics of a local component (e.g. damper or valve) and calculated system variables and a feedback means for generating a feedback control signal based on measured system variables. The controller then controls the component based on a combination of the feedforward control signal and the feedback signal.

The local controller comprises two separate processes, an identification process and a control process. The identification process identifies certain characteristics of the local component. These identified characteristics are output to the control process. The control process accepts the identified characteristics, along with other signals, and outputs a control signal so as to provide global control of the HVAC system Especially, the identification process utilizes a look-up table to store characteristics of the local component. These characteristics are the ratio of the pressure drop across the local component to the branch pressure drop when the component is fully open (vale authority in case of a valve), the percentage of flow through the component normalized to the maximum flow through the component.

The control process is divided into a feedforward process and a feedback process. The feedback process accepts as input a calculated flow setpoint and also a feedforward control signal. These signals are utilized by the feedback process to generate a control signal.

The feedforward process starts by first receiving the fan static pressure setpoint. The fan static pressure setpoint is used to calculate the pressure loss for each of the i branches connecting the fan outlet and the individual local damper. Especially, the pressure loss for each of the i branches is determined adaptively, in real-time. To calculate the pressure loss for branch 1, certain calculating steps are followed. The next step is to calculate the pressure loss of a second segment. This pressure loss is added to the pressure loss for the first segment to yield the pressure loss for the branch 1. This method of calculating pressure loss applies for i additional branches connected to the main duct.

Document U.S. Pat. No. 6,095,426 generally relates to control systems, and more particularly to control systems that are used in heating, ventilating and air conditioning fluid distribution systems.

U.S. Pat. No. 6,095,426 discloses a controller for controlling the temperature within a room in a building having at least one space adjacent to the room, the building having a heating, ventilating and air conditioning (HVAC) system with a supply duct adapted to supply air to the room and a general exhaust duct adapted to exhaust air from the room. The system has a local component for controlling the supply air flow into the room, the room having at least one additional exhaust independent of the HVAC system. The controller comprises a feedforward means for generating a feedforward control signal based on a desired temperature and flow set points in the supply duct, the flow into and out of the room, the flow set point in the general exhaust duct, and based on identifying characteristics of the component and calculated system variables. The controller further comprises a feedback means for generating a feedback control signal based on measured system variables, and means for combining the feedforward control signal and the feedback control signal to achieve control of the local component.

U.S. Pat. No. 6,095,426 also discloses a method of determining the value of a control signal in a controller for controlling the outlet air temperature from an air supply duct to a room, the air supply duct being part of an HVAC system of a building, the air duct having a heating coil adapted to heat the air moving through the duct and a flow valve for controlling the flow of hot water through the heating coil. The controller is of the type which has an identification means for periodically producing identified characteristics of the heating coil and valve and means for measuring the temperature of the air at the outlet of the duct, means for measuring the air flow rate through the duct and means for measuring the water pressure across the valve and in the system in which the valve is connected. The control signal is based on control set points and the identified characteristics of the heating coil and valve. The method comprises the steps of activating said identification means to determine the effectiveness of the coil in transferring heat to the air flowing through the duct, utilizing said coil characteristic to yield a desired water flow rate through the heating coil for a given measured duct outlet air temperature and air flow rate, measuring the pressure drop across the valve to the overall pressure drop in the system when the valve is fully open and determining the ratio of the former to the latter to derive the authority value for the valve, and generating said control signal as a function of the water flow rate and the valve authority.

Document EP 1 235 131 B1 discloses a process of controlling the room temperature, comprising a first temperature sensor for metering the room temperature, a second temperature sensor for metering the lead temperature of a heating medium, a third temperature sensor for metering the return temperature of the heating medium, and a control unit for actuating a valve for the flow of the heating medium. Within this process the operating characteristic of the valve is determined from the measured values of temperature sensors for the room, lead and return temperatures, with the control parameters of the room temperature control being adjusted to the operating characteristic in response to the point of operation of the valve.

Document CN 105335621 A relates to an electric adjusting valve model selection method. The electric adjusting valve model selection method comprises the following steps: determining a use performance of an electric adjusting valve, selecting a flow property curve type of the valve according to the use performance, primarily selecting the diameter of a valve seat; according to the primarily-selected diameter of the valve seat, inquiring a design manual to obtain a valve adjustable ratio R, a flowing capability kv of the valve and valve authority S, determining the maximum aperture value K=90% and the minimum aperture value K=30% of the diameter of the valve seat; substituting the parameters including the R, kv, S, K=90% and K=30% into an actual flow property formula of the electric adjusting valve respectively to obtain a flow under the 30% aperture and a flow under the 90% aperture; determining whether a flow range $Q_{min}$-$Q_{max}$ of a cooling water system connection pipe ranges from $Q_{30\%}$ to $Q_{90\%}$ or not; if the $Q_{min}$-$Q_{max}$ ranges from $Q_{30\%}$ to $Q_{90\%}$, finishing model selection; and if the $Q_{min}$-$Q_{max}$ does not range from $Q_{30\%}$ to $Q_{90\%}$, returning back to the step of primarily selecting the diameter of the valve seat and continually carrying out the model selection until the diameter of the valve seat meets the conditions. According to the method provided, model selection parameters of the valve and operation conditions of a cooling water system are matched, so that the valve can express a relatively good adjusting performance.

In general, a poor valve authority leads to poor system control and instability.

Another problem is the so-called "hunting": The control of a hydronic circuit may be prone to unwanted oscillations, which also lead to poor system control and instability.

Document WO 2006/105677 A2 discloses a method and a device for suppressing vibrations in an installation comprising an actuator for actuating a flap or a valve used for metering a gas or liquid volume flow, especially in the area of HVAC, fire protection, or smoke protection. Vibrations of the flap or valve caused by an unfavorable or wrong adjustment or configuration of the controller and/or by disruptive influences are detected and dampened or suppressed by means of an algorithm that is stored in a microprocessor. Said algorithm is preferably based on the components recognition of vibrations, adaptive filtering, and recognition of sudden load variations.

SUMMARY OF THE INVENTION

It is an object of the invention, to provide a hydronic system, which avoids certain disadvantages of known hydronic systems and is in a simple way able to adapt to changes in hydraulic parameters of the system.

In it another object of the invention to teach a method for operating such a system.

These and other objects are obtained by claims 1, 10, 11, 16 and 19.

The hydronic system according to the invention comprises at least one hydronic circuit and a control for controlling the operation of said at least one hydronic circuit via a control path, whereby said control comprises a feed forward controller.

It is characterized in that said hydronic system further comprises a control improvement path running from said at least one hydronic circuit to said control, by means of which control improvement path said control can be improved in the case of said hydronic system becoming instable and/or showing poor system control.

According to an embodiment of the invention said at least one hydronic circuit comprises a control valve as a variable flow resistance and a static flow resistance, which are connected in series by a piping, whereby said control valve is controlled by a valve control device, in that a flow sensor is provided for measuring the flow of a fluid flowing through said circuit, and in that a valve authority determining device is associated with said hydronic circuit, whereby said valve authority determining device is connected to said valve control device in order to receive information about the actual opening position of said control valve, and whereby said valve authority determining device is further connected to said flow sensor in order to receive information about the actual fluid flow flowing through said circuit.

A storage may be associated with said valve authority determining device, which storage contains and provides said valve authority determining device with, information on a valve characteristic of said control valve.

Also, an outlet of said valve authority determining device may be connected to said feed forward controller.

According to an embodiment of the invention a frequency detector for detecting oscillations is provided in said hydronic system, and said frequency detector is in operative connection with said control.

Said control may comprise oscillation suppressing means, and said frequency detector may be in operative connection with said oscillation suppressing means.

Furthermore, said feed forward controller may comprise a physical model of said hydronic circuit, and that said oscillation suppressing means may have an effect on input and/or output signals of said physical model.

Especially, said oscillation suppressing means may comprise at least one filter.

According to another embodiment of the invention said control may comprise an alternative controller, and said frequency detector may be in operative connection with switching means for switching between said feed forward controller and said alternative controller.

A method for operating a hydronic system according to the invention, which comprises a control valve as a variable flow resistance and a static flow resistance, which are connected in series by a piping, whereby said control valve is controlled by a valve control device, in that a flow sensor is provided for measuring the flow of a fluid flowing through said circuit, and in that a valve authority determining device is associated with said hydronic circuit, whereby said valve authority determining device is connected to said valve control device in order to receive information about the actual opening position of said control valve, and whereby said valve authority determining device is further connected to said flow sensor in order to receive information about the actual fluid flow flowing through said circuit, comprises the steps of a. providing a valve characteristic of said control valve, which comprises the dependency of the flow coefficient (kv) of said valve on the opening position of said valve;
b. moving said control valve into a first opening position having a first flow coefficient ($kv_{valve,1}$);
c. measuring the flow ($\Phi_1$) of said circulating fluid through said control valve in said first opening position;
d. moving said control valve into a second opening position having a second flow coefficient ($kv_{valve,2}$);
e. measuring the flow ($\Phi_2$) of said circulating fluid through said control valve in said second opening position;
f. determining from said measured flows ($\Phi_1$, $\Phi_2$) and the respective flow coefficients ($kv_{valve,1}$, $kv_{valve,2}$) the valve authority (N) using the formula $$N = \frac{(kv_{circuit})^2}{(kv_{circuit})^2 + (kvs_{valve})^2}$$

with $$kv_{circuit} = \sqrt{\frac{(\Phi_2^2 - \Phi_1^2)}{\frac{\Phi_1^2}{kv_{valve,1}^2} - \frac{\Phi_2^2}{kv_{valve,2}^2}}}$$

and $kvs_{valve}$ being the flow coefficient of the fully opened valve.

Another method for operating a hydronic system according to the invention, which comprises a control valve as a variable flow resistance and a static flow resistance, which are connected in series by a piping, whereby said control valve is controlled by a valve control device, in that a flow sensor is provided for measuring the flow of a fluid flowing through said circuit, and in that a valve authority determining device is associated with said hydronic circuit, whereby said valve authority determining device is connected to said valve control device in order to receive information about the actual opening position of said control valve, and whereby said valve authority determining device is further connected to said flow sensor in order to receive information about the actual fluid flow flowing through said circuit, comprises the steps of:

a. Providing a shape of a valve characteristic of said control valve, which comprises the principal dependency of the flow coefficient (kv) of said valve on the opening position of said valve;
b. moving said control valve into a first opening position;
c. measuring the flow ($\Phi_1$) of said circulating fluid through said control valve in said first opening position;
d. moving said control valve into a second opening position different from said first position;
e. measuring the flow ($\Phi_2$) of said circulating fluid through said control valve in said second opening position;
f. moving said control valve into a third opening position different from said first and second opening position;
measuring the flow ($\Phi_3$) of said circulating fluid through said control valve in said third opening position;

h. determining from the three measured flows ($\Phi_1$, $\Phi_2$, $\Phi_3$) the flow coefficients of the circuit, $kv_{circuit}$, and the fully opened control valve (12), $kvs_{valve}$; and i. determining the valve authority (N) of said control valve (12) using the formula $$N = \frac{(kv_{circuit})^2}{(kv_{circuit})^2 + (kvs_{valve})^2}.$$

Said valve authority may be determined at predetermined times during the lifetime of said hydronic system.

Especially, said valve authority may be determined during a commissioning of said hydronic system.

In addition, said valve authority may be determined at least a second time during the lifetime of said hydronic system.

Furthermore, said valve control device may comprise a feed-forward part, and said determined valve authority may be used as a parameter in said feed-forward part of said valve control device.

Another method for operating a hydronic system according to the invention, wherein a frequency detector for detecting oscillations is provided in said hydronic system, and said frequency detector is in operative connection with said control, comprises the steps of:

a. monitoring a flow through said hydronic system and/or a set point signal by means of said frequency detector;

b. acting on said control, when an oscillation is detected by said frequency detector.

Especially, oscillation suppressing means may be activated in said control, when an oscillation is detected by said frequency detector.

Alternatively, said feed forward controller may be replaced by an alternative controller, when an oscillation is detected by said frequency detector.

Another method for operating a hydronic system according to the invention, wherein a frequency detector for detecting oscillations is provided in said hydronic system, and said frequency detector is in operative connection with said control, and wherein said control comprises an alternative controller, and said frequency detector is in operative connection with switching means for switching between said feed forward controller and said alternative controller, comprising the steps of:

a. monitoring a flow through said hydronic system and/or a set point signal by means of said frequency detector;

b. replacing said alternative controller by said feed forward controller, when an oscillation is detected by said frequency detector.

BRIEF DESCRIPTION OF THE DRAWINGS

The present invention is now to be explained more closely by means of different embodiments and with reference to the attached drawings.

FIG. 4 shows a diagram related to a first method of authority learning used in the present invention;

FIG. 5 shows a diagram related to a second method of authority learning used in the present invention;

DETAILED DESCRIPTION OF DIFFERENT EMBODIMENTS OF THE INVENTION

Figure 1:
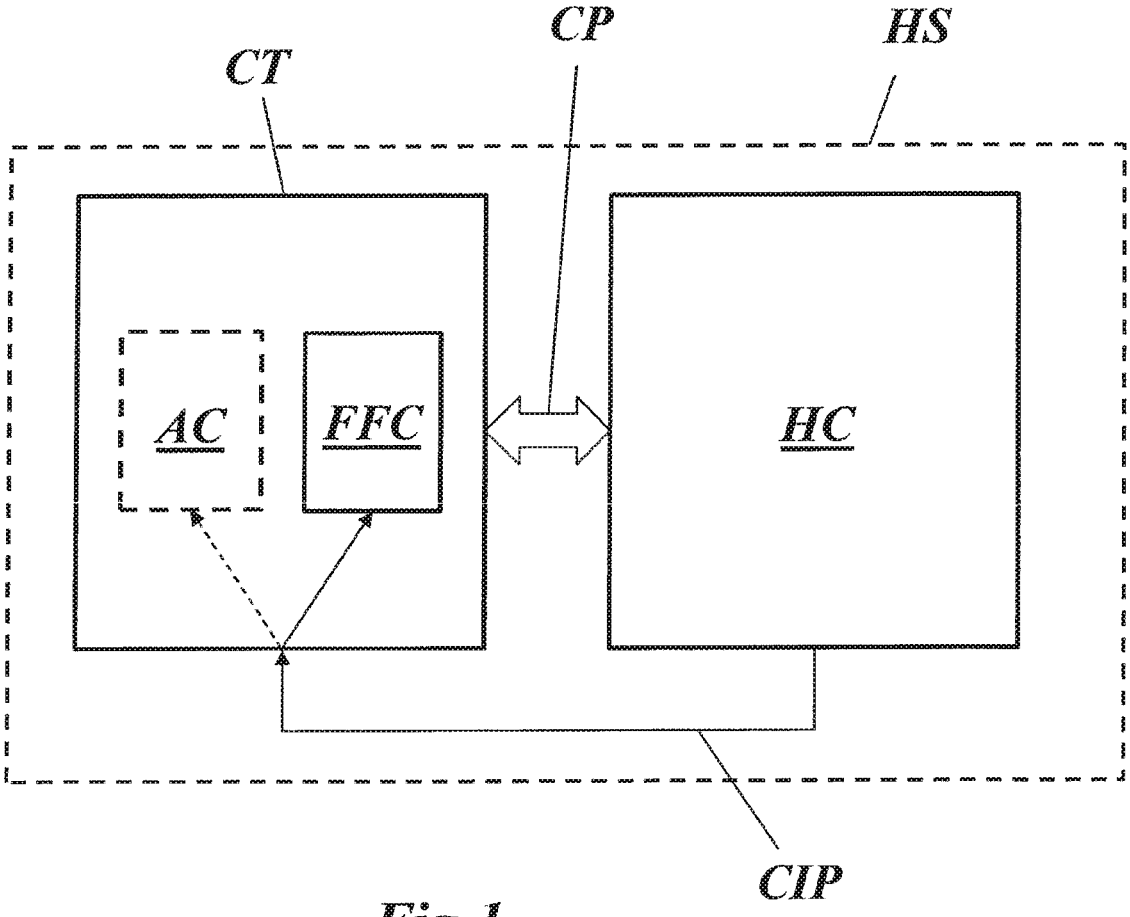
FIG. 1 shows in a generalized configuration a hydronic system according to an embodiment of the invention comprising a hydronic circuit and a control interacting by means of a control path and a control improvement path.

FIG. 1 shows in a generalized configuration a hydronic system HS according to an embodiment of the invention. Hydronic system HS comprises a hydronic circuit HC, which is usually associated with a building and includes piping, valves, heat exchangers, pumps, and the like, and a control CT interacting by means of a control path CP and a control improvement path CIP. Control path CP is related to the communication between control CT and hydronic circuit, and is the path for exchanging control signals from control CT to hydronic circuit HC, and operating parameters from hydronic circuit HC to control CT. Control CT comprises a feed forward controller FFC, which contains a physical model of hydronic circuit HC. Control CT may further comprise an alternative controller AC, which may replace feed forward controller FFC, and vice versa. The switching between the two controllers FFC and AC is symbolized in FIG. 1 by a selector switch.

An improvement of the control may be achieved in different ways, depending on the situation in the hydronic circuit:

During commissioning of the system it may be necessary and/or advantageous to adapt the control CT to certain parameters of the system, which were unknown prior to commissioning.

Operation of the system for a longer time may result in a change of important system parameters and/or a degradation, which may lead to poor system control and instability.

There are especially two cases, which are of concern with regard to the controllability of the hydronic system:

1) As long as control valves are part of the hydronic circuit, the so-called "valve authority" is an important parameter: Poor valve authority leads to poor system control and instability 2) Sometimes hydronic systems are prone to undesirable oscillations, so-called "hunting": Hunting signals, too, lead to poor system control and instability.

According to the invention, negative implications of a change of valve authority over time or an insufficient knowledge of the actual valve authority will be avoided by a respective improvement of the control.

Figure 2:
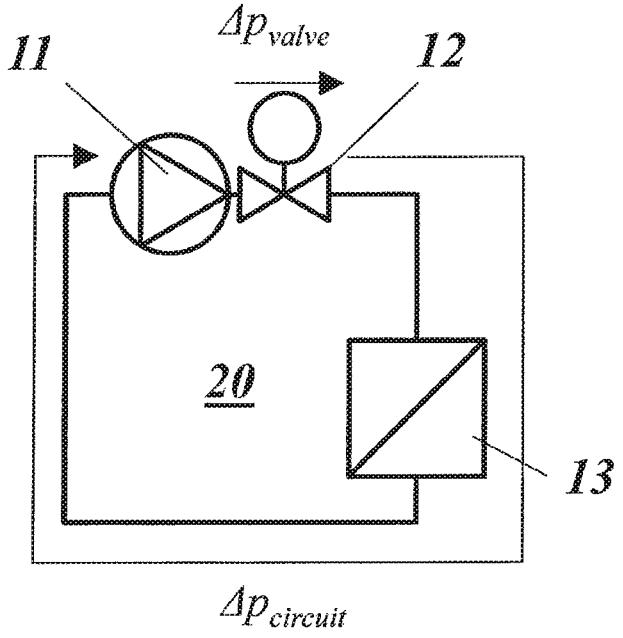
FIG. 2 shows a basic hydronic circuit comprising a pump, a control valve and a heat exchanger.

As has been already described in the introductory part FIG. 2 shows a hydronic system 20 in its most general form, which comprises in a closed circuit a pump 11, a two-port control valve 12 and a terminal unit, in this case a heat exchanger 13. Pump 11, control valve 12 and terminal unit 13 are connected in series. When pump 11 pumps the fluid through the circuit with a certain pressure, there are pressure drops Δp in the various sections of the system. These pressure drops or differential pressures can be divided into a first differential pressure $\Delta p_{valve}$ at the control valve 12 and a second differential pressure $\Delta p_{circuit}$ at the rest of the circuit.

In such a circuit the valve authority N is the pressure drop across the fully open valve in relation to the pressure drop across the whole system. Valve authority N, which is defined by equations (1) to (4) above, indicates how good the hydronic system is controllable (the higher the valve authority N, the better the hydronic system can be controlled). However, valve authority N is not a parameter, which is constant through the lifetime of the system. When valve authority N changes as a result of changes in the system, it will be advantageous to have a valve authority learning capability of the system in order to adapt the control mechanism of the system to the changing system environment.

The present invention deals with such valve authority learning.

Within the scope of the present invention at least two different procedures of valve authority learning are possible. Both of them include active measurements at the valve in the hydraulic circuit, meaning the valve is actively moved between different valve positions.

A first of these at least two different procedures is chosen, when the whole valve characteristic is known. In this case the curve kv vs. valve position shown in FIG. 4(*a*) is known. Further, as a primary assumption, there shall be a constant pressure across the relevant zone of the system.

To evaluate the actual valve authority of control valve 12, the valve is moved to two different positions. These positions are in FIG. 4 characterized through two respective kv-values, namely $kv_{valve,1}$(for position 1) and $kv_{valve,2}$(for position 2). In each of these two positions the related flow Φ is measured (FIG. 4(*b*)) and stored together with its associated kv-value, thus giving pairs of values $\Phi_1$, $kv_{valve,1}$ and $\Phi_2$, $kv_{valve,2}$.

Based on these pairs of values, the actual valve authority N can be calculated by means of the following formulas:

$$N = \frac{(kv_{circuit})^2}{(kv_{circuit})^2 + (kvs_{valve})^2} \tag{5}$$

$$kv_{circuit} = \sqrt{\frac{(\Phi_2^2 - \Phi_1^2)}{\frac{\Phi_1^2}{kv_{valve,1}^2} - \frac{\Phi_2^2}{kv_{valve,2}^2}}} \tag{6}$$

A second of these at least two different procedures is chosen, when only the shape of the valve characteristic is known, but no scaling is available. In this case the curve kv vs. valve position (shown in FIG. 5(*a*)) is a function F(kvs, $n_{gl}$) of the value kvs and a parameter $n_{gl}$, which is a measure of how sharply the characteristic curve is curved. For example, when the curve represents a valve with an "equal percentage characteristic", $n_{gl}$=3. Curves with other values of $n_{gl}$ are shown in FIG. 5(*a*) with dash and dot-and-dash lines.

Again, as a primary assumption, there shall be a constant pressure across the relevant zone of the system.

Now, the valve is moved to three (different) positions (FIG. 5(*b*)). The respective flows $\Phi_1$, $\Phi_2$ and $\Phi_3$ are measured at these positions and stored.

Finally, an equation system with 3 unknowns $kv_{circuit}$, $kvs_{valve}$ and Δp can be solved using the stored flows.

Figure 3:
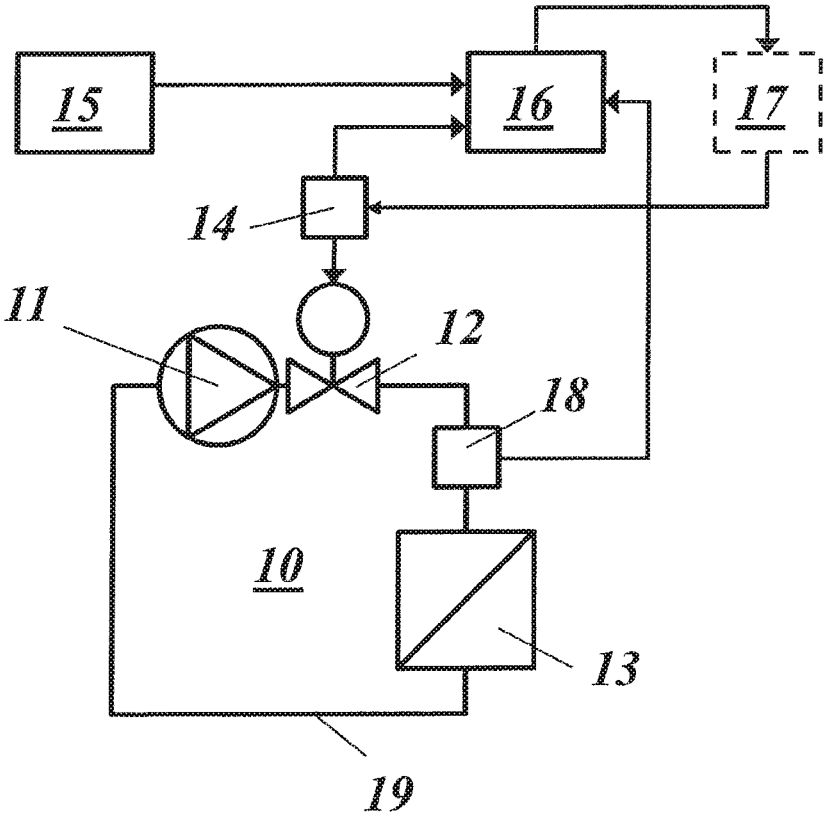
FIG. 3 shows a "learning" hydronic system according to an embodiment of the invention based on the circuit of FIG. 2 and further comprising control means capable of reacting to changes of certain parameters of the hydronic circuit by valve authority learning.

To move control valve 12 into the different positions and measure the respective flow circulating through piping 19 and said valve a valve control device 14 and a flow sensor 18 are provided in a hydronic system 10 in accordance with FIG. 3. Both devices are connected to a valve authority determining device 16, which controls the measuring action of control valve 12 and flow sensor 18. Storage 15 may be used to store certain parameters of the valve characteristic, which are necessary for a valve authority calculation, as explained above. The valve authority measured and calculated by valve authority determining device 16 from time to time may be transferred to a valve authority using unit 17, as indicated. Valve authority unit 17 then may control valve control device 14, accordingly.

Valve authority N may be determined at predetermined times during the lifetime of hydronic system 10. Furthermore, valve authority N may be determined during a commissioning of hydronic system 10, and, preferably, at least a second time during the lifetime of said hydronic system.

Figure 6:
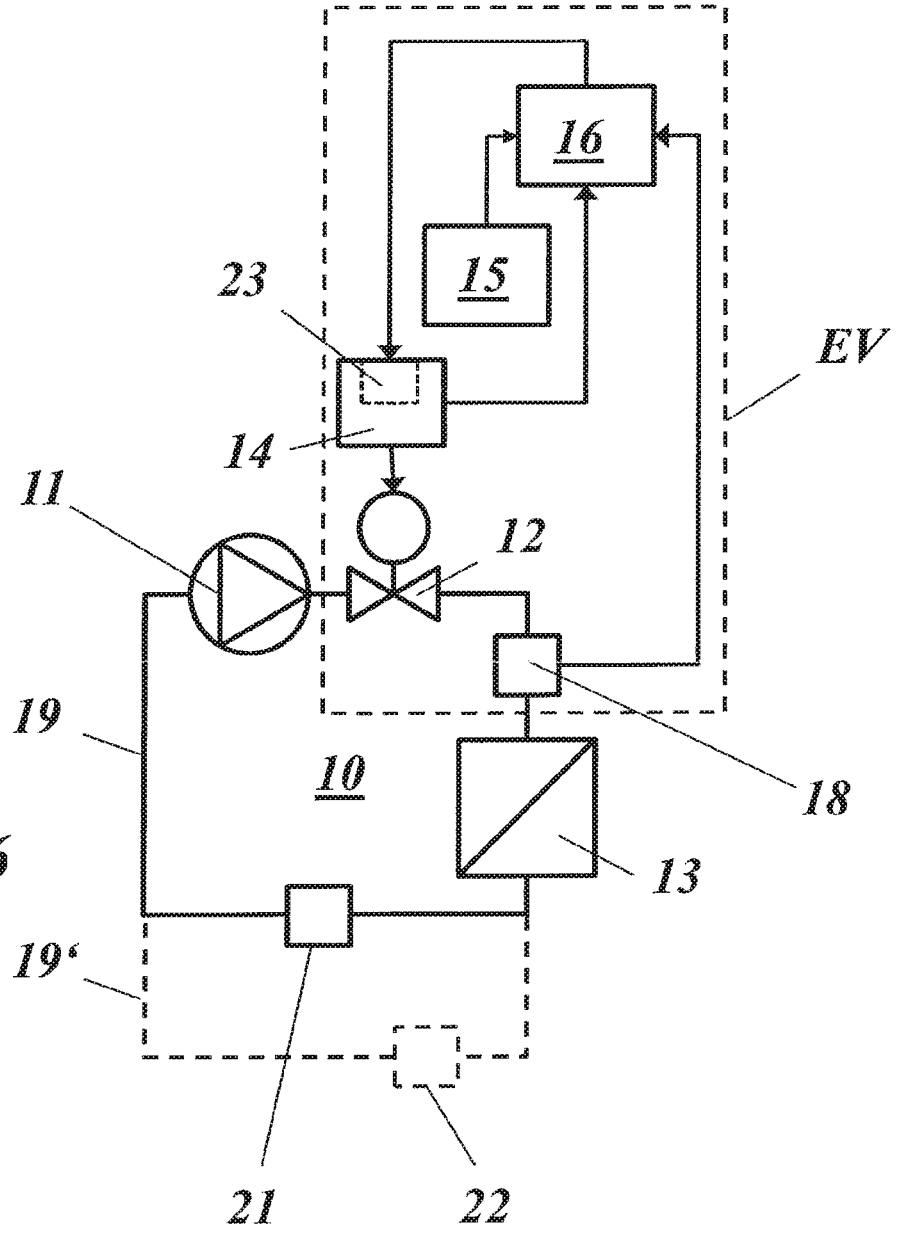
FIG. 6 shows a "learning" hydronic system according to another embodiment of the invention.

As valve control device 14 comprises (besides a possible feedback) a feed-forward part 23, as shown in FIG. 6, said determined valve authority N may be used as a parameter in feed-forward part 23 of valve control device 14.

Hydronic circuit 10, as shown in FIG. 6, may be a simple circuit with a pump 11, a control valve 12 and a heat exchanger 13. However, there may be further circuit elements 21 and branches comprising further piping 19' and circuit elements 22.

Finally, the arrangement of control valve 12, valve control device (or actuator) 14, flow sensor 18 and valve authority determining device 16 and storage 15 may be combined in one unit, which is known as "energy valve" EV (see for example EP 2 896 899 A1).

Figure 7:
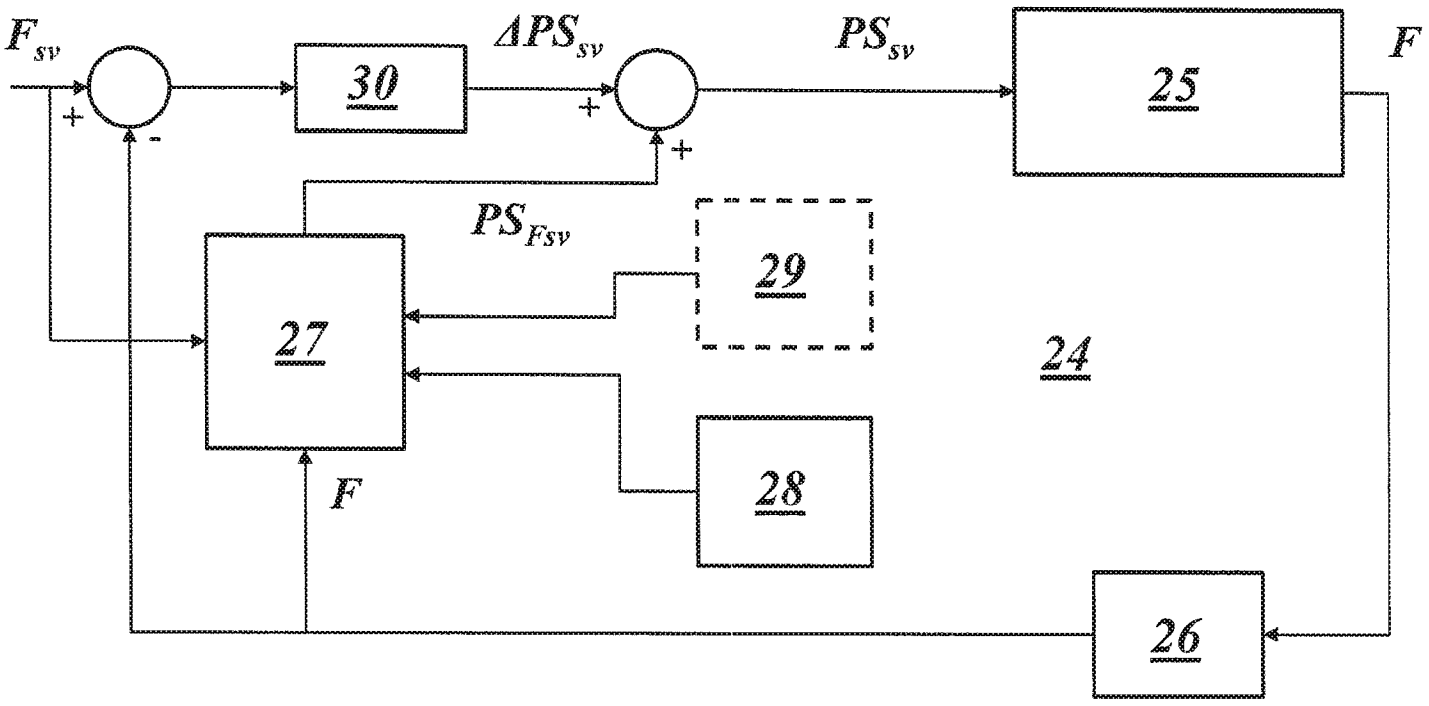
FIG. 7 shows a feed forward control scheme, which may be used to implement the valve authority learning method according to the present application.

FIG. 7 shows a feed forward control scheme, which may be used to implement the valve authority learning strategy explained so far. Central part of forward control scheme 24 of FIG. 7 is a physical model 27 of the hydronic system in question. When a flow set value $F_{sv}$ is given, the physical model 27 generates a feed forward position set value $PS_{Fsv}$ by using flow set value $F_{sv}$, the measured actual flow, F, valve authority 28 and other input parameters 29, e.g. the valve characteristic. Added to said feed forward position set value $PS_{Fsv}$ is a deviation of valve position set value, $\Delta PS_{sv}$, which is determined by deviation part 30 from the difference between flow set value $F_{sv}$ and measured actual flow F. Deviation part 30 comes up for small deviations due to a mismatch of physical model 27 and reality. The sum of $PS_{Fsv}$ and $\Delta PS_{sv}$ is finally used as valve position set value $PS_{sv}$ for controlling the controlled system flow 25. The resulting actual flow F is measured by flow sensor 26.

The valve authority 28 put into the physical model 27 is the valve authority determined by the methods explained above. In this way the feed forward control can react to changes of this relevant system parameter in order to improve system control and stability.

However, as already mentioned above, other characteristics of the system than valve authority may trigger an action on the feed forward control scheme. For example, document WO 2006/105677 A2 discloses a method and a device for suppressing vibrations in an installation comprising an actuator for actuating a flap or a valve used for metering a gas or liquid volume flow, especially in the area of HVAC, fire protection, or smoke protection. Vibrations of the flap or valve caused by an unfavorable or wrong adjustment or configuration of the controller and/or by disruptive influences are detected and dampened or suppressed by means of an algorithm that is stored in a microprocessor. Said algorithm is preferably based on the components recognition of vibrations, adaptive filtering, and recognition of sudden load variations.

Specifically, according to the document, a regulating variable from the regulating path is provided, whereby said regulating variable corresponding to the effective liquid volume flow. Further, a predefined control signal corresponding to the required liquid volume flow is provided. The predefined control signal and the regulating variable are compared and a regulator output variable is calculated therefrom. The regulator output variable is monitored by a vibration detection algorithm. If the vibration detection algorithm does not detect vibrations of the regulator output variable, the regulator output variable is fed to an actuating device which is actuating a flap or a valve in the pipe for dosing the gas or liquid volume flow. If, on the other hand, the vibration detection algorithm detects vibrations of the regulator output variable, the regulator output variable is fed to an adaptive filter and the adaptive filter suppresses the vibration and generates a control signal with suppressed or damped vibrations of the regulator output variable, which is then used at the actuating device instead of the regulator output variable.

Figure 8:
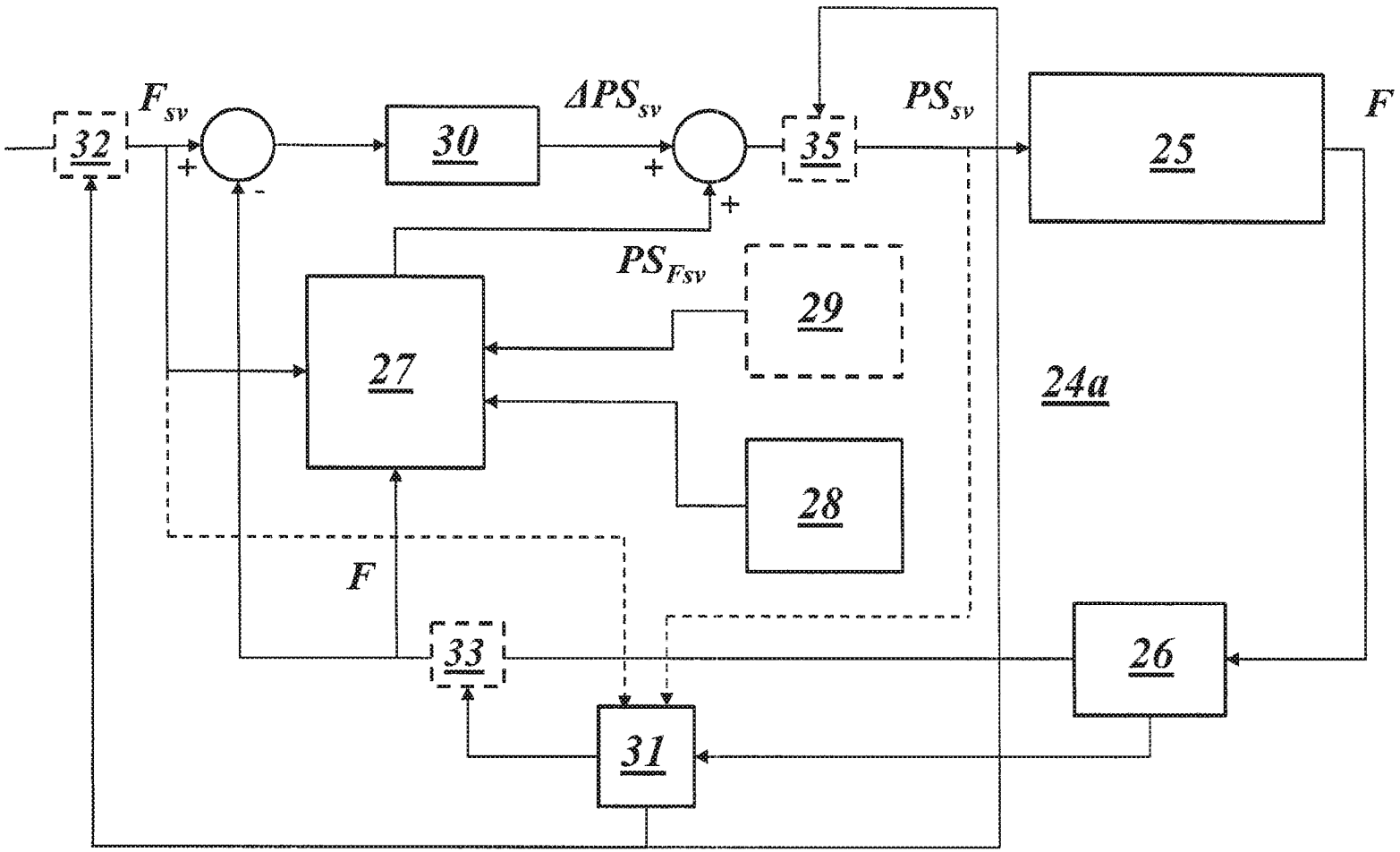
FIG. 8 shows a modified feed forward control scheme, which may be used to suppress unwanted oscillations of the system.

In the present case of a feed forward control scheme the situation is different: As shown in FIG. 8, a modified feed forward control scheme 24*a* may be used to suppress unwanted oscillations of the system. To detect unwanted oscillations of the system, a frequency detector 31 may be connected to flow sensor 26. When frequency detector 31 detects unwanted oscillations in the system, appropriate input or output signals of the physical model 27 will be compensated or filtered (e.g. with lead or lag filters or a combination thereof). As an example, FIG. 8 shows two filters 32 and 33 (dashed lines) at the input of the flow set value $F_{sv}$ and the output of floe signal F of flow sensor 26. A further filtering means 35 may be used to filter the valve position set value ($PS_{sv}$). Other locations of filtering and/or compensating are possible.

In addition, setpoint signals flow set value $F_{sv}$ and/or position set value $PS_{sv}$ may be monitored by frequency detector 31.

Figure 9:
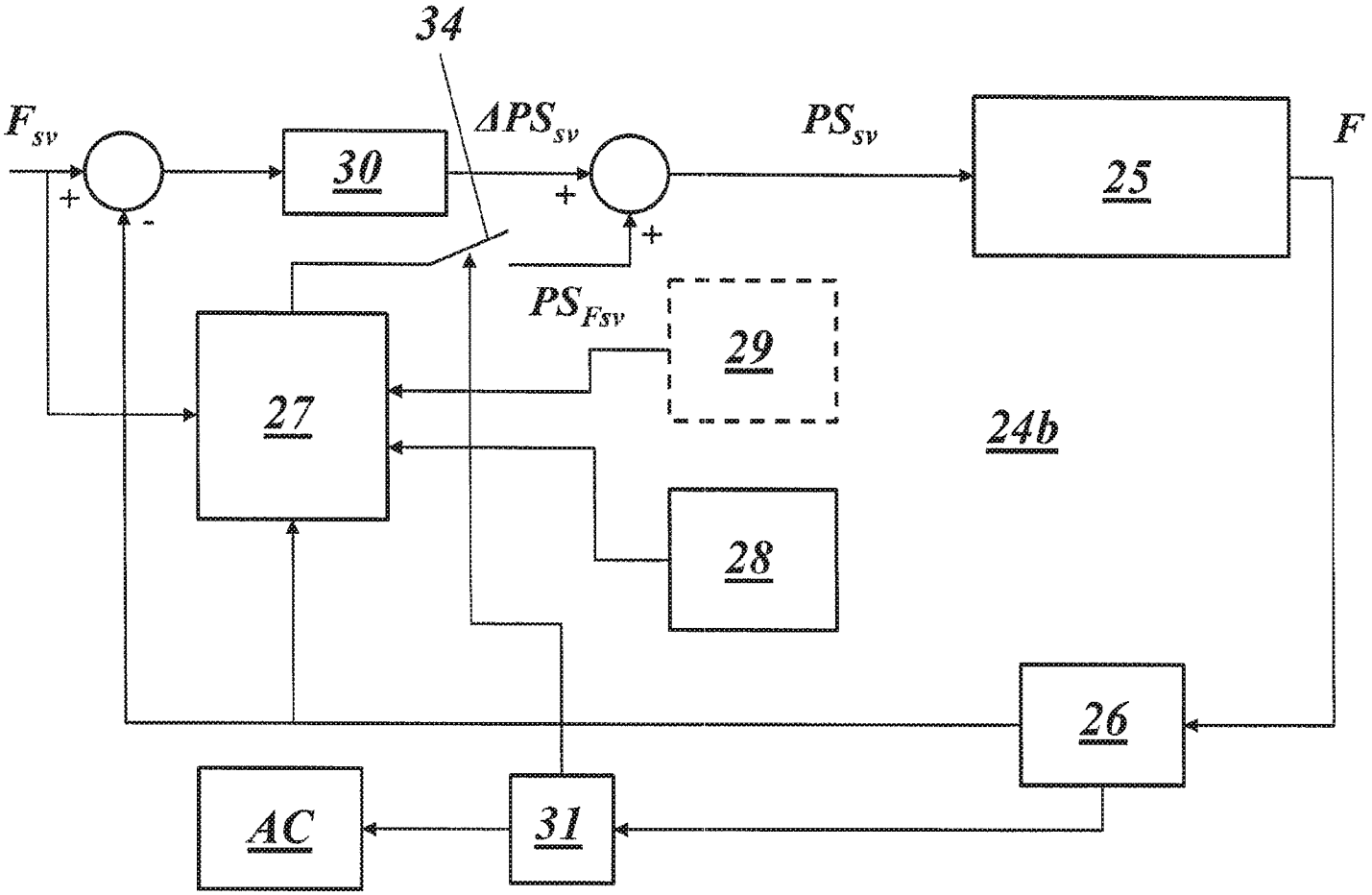
FIG. 9 shows another way of dealing with unwanted oscillations of the system by switching between different controllers.

Another way of dealing with unwanted oscillations of the system is shown in FIG. 9: When unwanted oscillations are detected by frequency detector 31 of feed forward control scheme 24*b*, it actuates a disabling means 34 (e.g. a switch) to shut down the actual feed forward control and replace it with an alternative, more suitable and oscillation-free controller AC. The switching may be reversed in other situations, so that the system switches from an alternative controller AC to a feed forward controller to improve stability and control.

LIST OF REFERENCE NUMERALS

10, 20 hydronic circuit
11 pump
12 control valve
13 heat exchanger
14 valve control device (or actuator)
15 storage
16 valve authority determining device
17 valve authority using unit
18 flow sensor
19, 19' piping
21,22 circuit element
23 feed-forward part (valve control device)
24 feed forward control scheme
24*a*,*b* feed forward control scheme
25 controlled system flow
26 flow sensor
27 physical model
28 valve authority
29 other input parameters (e.g. valve characteristic)
30 deviation part
31 frequency detector
32, 33 filter
34 disabling means (e.g. switch)
35 filtering means
AC alternative controller
CIP control improvement path
CP control path
CT control
EV energy valve
F flow
$F_{sv}$ flow set value
FFC feed forward controller
HC hydronic circuit
HS hydronic system
$\Delta PS_{sv}$ deviation of valve position set value
$PS_{sv}$ valve position set value
$PS_{Fsv}$ feed forward valve position set value
$kv_{valve}$ flow coefficent of control valve
$\Phi$ flow through control valve
$\Delta p_{valve}$ pressure drop at control valve
$\Delta p_{circuit}$ pressure drop at circuit outside control valve
♦

What is claimed is:

1. A hydronic system (HS) comprising:

at least one hydronic circuit (HC; 10; 20), a control (CT) for controlling the operation of said at least one hydronic circuit (HC; 10; 20) via a control path (CP) that communicates an exchange of control signals and operating parameters, whereby said control (CT) comprises a feed forward controller (FFC; 23) and an alternative controller (AC), and a control improvement path (CIP) running from said at least one hydronic circuit (HC; 10; 20) to said control (CT), wherein said alternative controller (AC) can replace the feed forward controller (FFC) and the feed forward controller (FFC) can replace the alternative controller (AC), whereby said control (CT) can be improved in the case of said hydronic system (HS) becoming instable and/or showing poor system control.

2. The hydronic system as claimed in claim 1, characterized in that said at least one hydronic circuit (10) comprises a control valve (12) as a variable flow resistance and a static flow resistance (13), which are connected in series by a piping (19, 19'), whereby said control valve (12) is controlled by a valve control device (14), in that a flow sensor (18) is provided for measuring the flow ($\Phi$) of a fluid flowing through said circuit, and in that a valve authority determining device (16) is associated with said hydronic circuit (10), whereby said valve authority determining device (16) is connected to said valve control device (14) in order to receive information about the actual opening position of said control valve (12), and whereby said valve authority determining device (16) is further connected to said flow sensor (18) in order to receive information about the actual fluid flow (Φ) flowing through said circuit.

3. The hydronic system as claimed in claim 2, characterized in that a storage (15) is associated with said valve authority determining device (16), which storage (15) contains and provides said valve authority determining device (16) with, information on a valve characteristic of said control valve (12).

4. The hydronic system as claimed in claim 2, characterized in that an outlet of said valve authority determining device (16) is connected to said feed forward controller (FFC).

5. The hydronic system as claimed in claim 1, characterized in that a frequency detector (31) for detecting oscillations is provided in said hydronic system, and that said frequency detector (31) is in operative connection with said control (CT).

6. The hydronic system as claimed in claim 5, characterized in that said control (CT) comprises oscillation suppressing means (32, 33, 35), and that said frequency detector (31) is in operative connection with said oscillation suppressing means (32, 33, 35).

7. The hydronic system as claimed in claim 6, characterized in that said feed forward controller (FFC) comprises a physical model (27) of said hydronic circuit, and that said oscillation suppressing means (32, 33, 35) has an effect on input and/or output signals of said physical model (27).

8. The hydronic system as claimed in claim 6, characterized in that said oscillation suppressing means comprises at least one filter (32, 33).

9. A method for operating a hydronic system according to claim 5, comprising the steps of:

a. monitoring a flow through said hydronic system and/or a set point signal ($F_{sv}$, $PS_{sv}$) by means of said frequency detector (31);

b. acting on said control (CT), when an oscillation is detected by said frequency detector.

10. The method as claimed in claim 9, characterized in that oscillation suppressing means (32, 33, 35) are activated in said control (CT), when an oscillation is detected by said frequency detector (31).

11. The method as claimed in claim 9, characterized in that said feed forward controller (FFC) is replaced by an alternative controller (AC), when an oscillation is detected by said frequency detector (31).

12. A hydronic system (HS) comprising:

at least one hydronic circuit (HC; 10; 20);

a control (CT) for controlling the operation of said at least one hydronic circuit (HC; 10; 20) via a control path (CP), whereby said control (CT) comprises a feed forward controller (FFC; 23); and a control improvement path (CIP) running from said at least one hydronic circuit (HC; 10; 20) to said control (CT), by means of which control improvement path (CIP) said control (CT) can be improved in the case of said hydronic system (HS) becoming instable and/or showing poor system control, wherein a frequency detector (31) for detecting oscillations is provided in said hydronic system, said frequency detector (31) being in operative connection with said control (CT), wherein said control (CT) comprises an alternative controller (AT), and wherein said frequency detector (31) is in operative connection with switching means for switching between said feed forward controller (FFC) and said alternative controller (AC).

13. A method for operating a hydronic system according to claim 12, comprising the steps of:

a. monitoring a flow through said hydronic system and/or a set point signal ($F_{sv}$, $PS_{sv}$) by means of said frequency detector (31);

b. replacing said alternative controller (AC) by said feed forward controller (FFC), when an oscillation is detected by said frequency detector (31).

14. The hydronic system as claimed in claim 12, wherein switching between the feed forward controller (FFC; 23) and the alternative controller (AC) is done by a selector switch (34).

15. A method for operating a hydronic system (HS), the hydronic system comprising at least one hydronic circuit (HC; 10; 20) and a control (CT) for controlling the operation of said at least one hydronic circuit (HC; 10; 20) via a control path (CP), whereby said control (CT) comprises a feed forward controller (FFC; 23), and a control improvement path (CIP) running from said at least one hydronic circuit (HC; 10; 20) to said control (CT), by means of which control improvement path (CIP) said control (CT) can be improved in the case of said hydronic system (HS) becoming instable and/or showing poor system control, wherein said at least one hydronic circuit (10) comprises a control valve (12) as a variable flow resistance and a static flow resistance (13), which are connected in series by a piping (19, 19'), whereby said control valve (12) is controlled by a valve control device (14), in that a flow sensor (18) is provided for measuring the flow (Φ) of a fluid flowing through said circuit, and wherein a valve authority determining device (16) is associated with said hydronic circuit (10), whereby said valve authority determining device (16) is connected to said valve control device (14) in order to receive information about the actual opening position of said control valve (12), and whereby said valve authority determining device (16) is further connected to said flow sensor (18) in order to receive information about the actual fluid flow (Φ) flowing through said circuit, said method comprising the steps of a. providing a valve characteristic of said control valve (12), which comprises the dependency of the flow coefficient (kv) of said valve on the opening position of said valve;

b. moving said control valve (12) into a first opening position having a first flow coefficient ($kv_{valve,1}$);

c. measuring the flow ($\Phi_1$) of said circulating fluid through said control valve (12) in said first opening position;

d. moving said control valve (12) into a second opening position having a second flow coefficient ($kv_{valve,2}$);

e. measuring the flow ($\Phi_2$) of said circulating fluid through said control valve (12) in said second opening position;

f. determining from said measured flows ($\Phi_1$, $\Phi_2$) and the respective flow coefficients ($kv_{valve,1}$, $kv_{valve,2}$) the valve authority (N) using the formula $$N = \frac{(kv_{circuit})^2}{(kv_{circuit})^2 + (kvs_{valve})^2} \text{ with } kv_{circuit} = \sqrt{\frac{(\Phi_2^2 - \Phi_1^2)}{\frac{\Phi_1^2}{kv_{valve,1}^2} - \frac{\Phi_2^2}{kv_{valve,2}^2}}}$$

and $kvs_{valve}$ being the flow coefficient of the fully opened valve.

16. The method as claimed in claim 15, characterized in that said valve authority (N) is determined at predetermined times during the lifetime of said hydronic system (10).

17. The method as claimed in claim 16, characterized in that said valve authority (N) is determined during a commissioning of said hydronic system (10).

18. The method as claimed in claim 17, characterized in that said valve authority (N) is determined at least a second time during the lifetime of said hydronic system (10).

19. The method as claimed in claim 16, characterized in that said valve control device (14) comprises a feed-forward part (23), and that said determined valve authority (N) is used as a parameter in said feed-forward part (23) of said valve control device (14).

20. A method for operating a hydronic system (HS), the system comprising at least one hydronic circuit (HC; 10; 20) and a control (CT) for controlling the operation of said at least one hydronic circuit (HC; 10; 20) via a control path (CP), whereby said control (CT) comprises a feed forward controller (FFC; 23), and a control improvement path (CIP) running from said at least one hydronic circuit (HC; 10; 20) to said control (CT), by means of which control improvement path (CIP) said control (CT) can be improved in the case of said hydronic system (HS) becoming instable and/or showing poor system control, wherein said at least one hydronic circuit (10) comprises a control valve (12) as a variable flow resistance and a static flow resistance (13), which are connected in series by a piping (19, 19'), whereby said control valve (12) is controlled by a valve control device (14), in that a flow sensor (18) is provided for measuring the flow (Φ) of a fluid flowing through said circuit, and wherein a valve authority determining device (16) is associated with said hydronic circuit (10), whereby said valve authority determining device (16) is connected to said valve control device (14) in order to receive information about the actual opening position of said control valve (12), and whereby said valve authority determining device (16) is further connected to said flow sensor (18) in order to receive information about the actual fluid flow (Φ) flowing through said circuit, said method comprising the steps of:

a. providing a shape of a valve characteristic of said control valve (12), which comprises the principal dependency of the flow coefficient (kv) of said valve on the opening position of said valve;

b. moving said control valve (12) into a first opening position;

c. measuring the flow ($\Phi_1$) of said circulating fluid through said control valve (12) in said first opening position;

d. moving said control valve (12) into a second opening position different from said first position;

e. measuring the flow ($\Phi_2$) of said circulating fluid through said control valve (12) in said second opening position;

f. moving said control valve (12) into a third opening position different from said first and second opening position;

g. measuring the flow ($\Phi_3$) of said circulating fluid through said control valve (12) in said third opening position;

h. determining from the three measured flows ($\Phi_1$, $\Phi_2$, $\Phi_3$) the flow coefficients of the circuit, $kv_{circuit}$, and the fully opened control valve (12), $kvs_{valve}$; and i. determining the valve authority (N) of said control valve (12) using the formula $$N = \frac{(kv_{circuit})^2}{(kv_{circuit})^2 + (kvs_{valve})^2}.$$

* * * * *